US005114141A

United States Patent [19]

Mahoney

[11] Patent Number: 5,114,141

[45] Date of Patent: May 19, 1992

[54] BASKETBALL RIM ASSEMBLY SUPPORT APPARATUS

[75] Inventor: Kenneth J. Mahoney, Dorrance, Kans.

[73] Assignee: Gared Sports, Inc., St. Louis, Mo.

[21] Appl. No.: 563,064

[22] Filed: Aug. 6, 1990

[51] Int. Cl.[5] ..... A63B 63/08

[52] U.S. Cl. ..... 273/1.5 R

[58] Field of Search ..... 273/1.5 R, 1.5 A; D21/201

[56] References Cited

U.S. PATENT DOCUMENTS

| | | | |
|---|---|---|---|
| D. 216,684 | 3/1970 | Haubert | D21/201 X |
| 2,363,634 | 11/1944 | Albach et al. | D21/201 X |
| 4,348,022 | 9/1982 | O'Donnell | 273/1.5 R |
| 4,433,839 | 2/1984 | Simonseth | 273/1.5 R |
| 4,588,188 | 5/1986 | Mahoney et al. | 273/1.5 R |
| 4,650,188 | 3/1987 | Schroeder | 273/1.5 R |
| 4,895,365 | 1/1990 | Schroeder | 273/1.5 R |

*Primary Examiner*—Paul E. Shapiro
*Attorney, Agent, or Firm*—Phillip A. Rein

[57] ABSTRACT

This invention relates to a basketball rim assembly support apparatus usable with either of two types of supporting for basketball backboard assemblies being 1) a four corner backboard support; or 2) a center mount backboard support. A four corner frame support and rim connector assembly includes a vertical support strut assembly extended between upper and lower support members of a generally rectangular backboard support frame having a backboard glass member mounted therein. A basketball rim support assembly is provided having a "U" shaped main support plate which is connected to the vertical support strut assembly; the lower support member of the backboard support frame; and to a rim anchor plate of a basketball rim assembly. This eliminates any support or contact from the basketball rim assembly directly or indirectly to the glass backboard member. In a center mount support and rim connector assembly, the vertical support strut assembly is not required as a "U" shaped main support plate member is directly connected between a support connector plate of the center mount backboard support; the lower support member of the backboard support frame; and to the rim anchor plate of the basketball rim assembly.

10 Claims, 2 Drawing Sheets

BASKETBALL RIM ASSEMBLY SUPPORT APPARATUS

PRIOR ART

The applicant herein is knowledgable in the area of prior art structures relative to breakaway basketball goals, basketball rim and backboard support structures, and other basketball products utilized by the NCAA and NBA basketball associations. To the applicant's knowledge, nothing exists that will achieve the function of the applicant's invention herein to prevent transferring a load from a basketball rim assembly directly to its' supporting glass backboard member which may cause breakage thereof. The invention herein presents an effective, low cost, and non-maintenance basketball rim support structure for preventing breakage of glass backboard members.

PREFERRED EMBODIMENT OF THE INVENTION

In one preferred embodiment of this invention, a basketball rim assembly support apparatus is provided which is connectable to a basketball backboard assembly and to a main backboard support assembly. The main backboard support assembly can consist of one of two main embodiments being 1) a four corner basketball support; or 2) a center mount backboard support with slight variations of the applicant's invention to accomodate the differences in subject backboard support structures. The basketball rim assembly support apparatus includes 1) a main basketball rim assembly; and 2) a support and rim connector assembly connected between the basketball rim assembly and the main backboard support assembly. The basketball rim assembly is of a conventional nature including a basketball rim member with a net member connected thereto and having the basketball rim member connected to a rim support assembly. The rim support assembly includes a rim anchor frame having a rim anchor plate which is connectable to the support and rim connector assembly. The support and rim connector assembly includes 1) a frame support and rim connector assembly; or 2) a center mount support and rim connector assembly includes a vertical support strut assembly connected between upper and lower support members of a backboard support frame of the basketball backboard assembly. The vertical support strut assembly includes an upper support strut assembly secured to the upper support member; an intermediate support strut secured at one end to the upper support strut assembly and at the lower end to a lower strut support assembly which, in turn, is secured to the lower support member of the backboard support frame. The basketball rim support assembly includes a main support plate member of generally "U" shape in transverse cross section and a rim and frame connector assembly. The main support plate member is connected to the lower strut support assembly and, additionally, to the rim anchor plate of the basketball rim assembly. The frame support and rim connector assembly is operable so as to be connected to the backboard support frame and to the basketball rim assembly without having any holes or contact with the glass backboard member to prevent breakage thereof. The center mount support and rim connector assembly is a second embodiment including a basketball rim support assembly and a rim and frame connector assembly. The basketball rim support assembly includes the main support plate member as previously described. The rim and frame connector assembly is operable to connect the main support plate member to the basketball rim assembly and, additionally, to an upright support connector plate of the center mount backboard support. In the second embodiment, the vertical support strut assembly is not needed due to the rigidity of the connector plate of the center mount backboard support.

OBJECTS OF THE INVENTION

One object of this invention is to provide a basketball rim assembly support apparatus which is connected between a basketball backboard assembly and a main backboard support assembly to support a basketball rim assembly without any contact with a glass backboard member to prevent breakage thereof.

One further object of this invention is to provide a basketball rim assembly support apparatus having means for connecting to a four corner backboard support or a center mount backboard support to provide rigid support to a basketball rim assembly without requiring drilling holes in a glass backboard member or contacting same to prevent breakage thereof.

One other object of this invention is to provide a basketball rim assembly support apparatus to rigidly support a basketball rim assembly so that any pressure thereupon is transferred to a main backboard support assembly and not to a glass backboard member to prevent breakage thereof.

Still, one further object of this invention is to provide a basketball rim assembly support apparatus to support a basketball rim assembly in a rigid manner without transferring forces thereon from a basketball dunking operation to a glass backboard member to prevent breakage thereof.

Still, another object of this invention is to provide a basketball rim assembly support apparatus which is economical to manufacture; rigid in construction; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
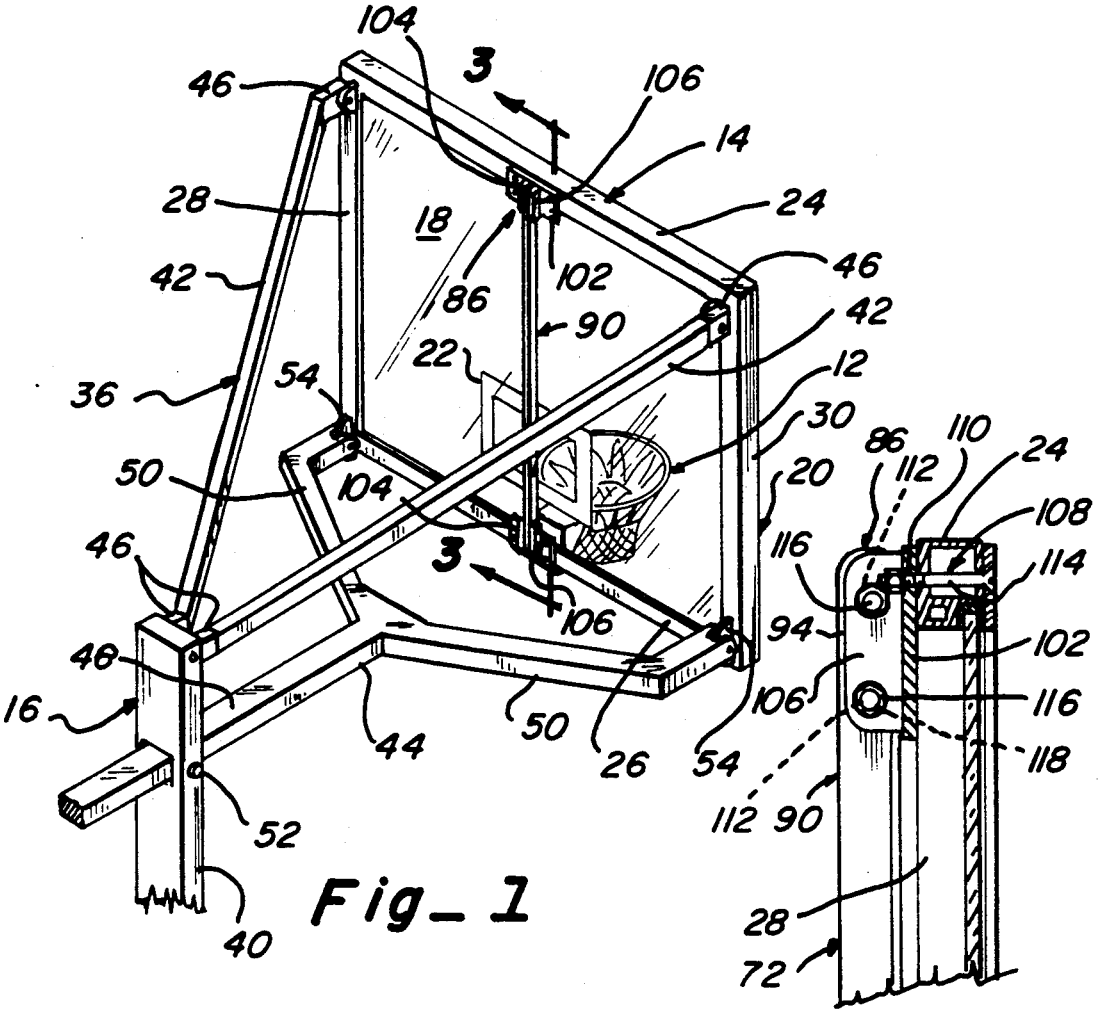
FIG. 1 is a perspective view of a basketball rim assembly support apparatus of this invention as connected to a four corner backboard support.

The following is a discussion and description of preferred specific embodiments of the basketball rim assembly support apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail and, in particular to FIG. 1, a basketball rim assembly support apparatus of this invention, indicated generally at 12, is shown as connected to a basketball backboard assembly 14 which, in turn, is connected to a main backboard support assembly 16 having two embodiments thereof.

The basketball backboard assembly 14 includes a glass backboard member 18 mounted within a rectangular backboard support frame 20. The glass backboard member 18 is of an official size and shape and having a central goal target indicia 22 thereon. The backboard support frame 20 includes an upper support member 24 and a lower support member 26 interconnected by spaced parallel side support members 28, 30. All of the support members 24, 26, 28, 30 are provided with glass support grooves 32 having "U" shaped support pads 34 therewithin adapted to receive the adjacent outer periphery of the glass backboard member 18 therein.

Figure 4:
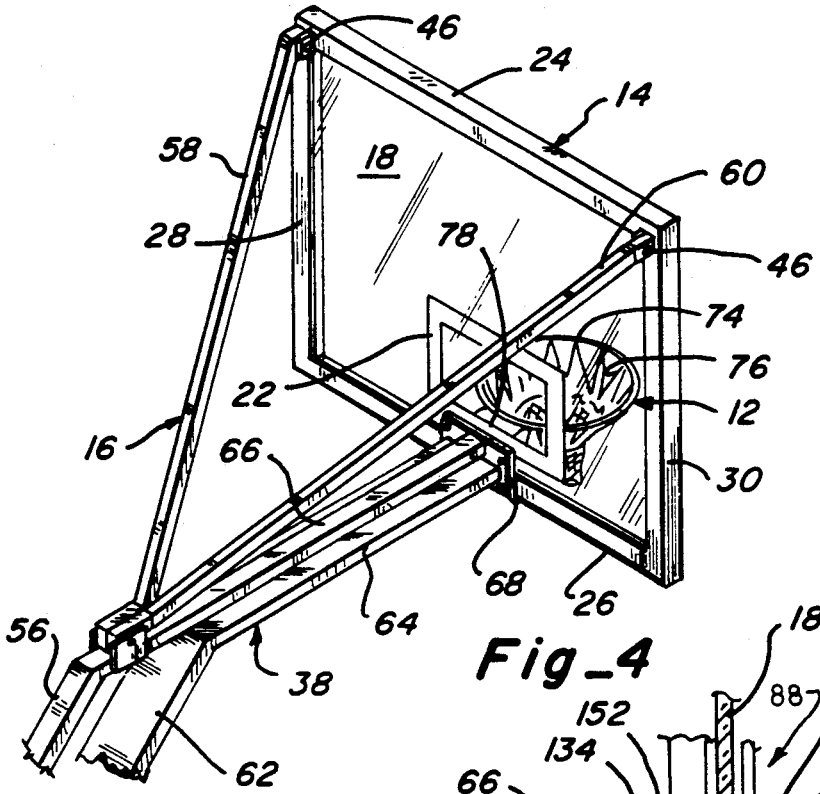
FIG. 4 is a view similar to FIG. 1 illustrating the basketball rim assembly support apparatus of this invention as secured to a center mount backboard support being a second embodiment of this invention.

The main backboard support assembly 16 has a pair of embodiments being 1) a four corner backboard support 36 as noted in FIG. 1; and 2) a center mount backboard support 38 as noted in FIG. 4.

The four corner backboard support 36 includes 1) a main vertical support post 40; 2) a pair of upper connector struts 42 each connected at one end to the vertical support post 40 and at the opposite end to respective upper outer corners of the backboard support frame 20; and 3) a lower support assembly 44. The upper support struts 42 are secured by connector members 46 to the upper outer corners of the backboard support frame 20.

The lower support assembly 44 includes a main support strut 48 connected at an outer end to lower support struts 50. The main support strut 48 has an adjustment member 52 which provides for proper positioning of the backboard support frame 20 and the glass backboard member 18 in a vertical plane.

The lower support struts 50 are provided with connector members 54 on outer ends thereof connected to respective lower corners of the backboard support frame 20.

As noted in FIG. 4, the center mount backboard support 38 is provided with 1) an inclined support post 56; 2) inclined upper support struts 58, 60 connected to respective upper outer corners of the backboard support frame 20; and 3) inclined lower support assembly 62 connected to a central portion of the backboard support frame 20. The inclined upper support struts 58, 60 are each provided with connector members 46 secured to the upper outer corners of the backboard support frame 20.

Figure 5:
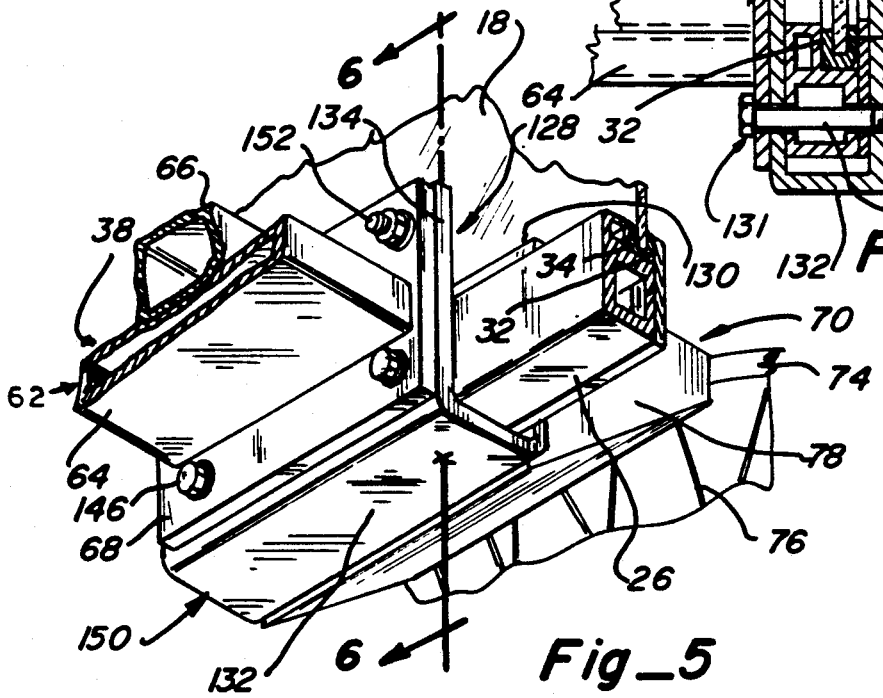
FIG. 5 is a view similar to FIG. 2 being an enlarged fragmentary perspective view illustrating a center mount support and rim connector assembly of the basketball rim assembly support apparatus of this invention.

As shown in FIG. 5, the inclined lower support assembly 62 is provided with a main base support member 64 having a top support member 66 secured thereto. The base support member 64 and the top support member 66 are secured at adjacent outer end as by welding or the like to an upright support connector plate 68. The support connector plate 68 is provided with a hole in each corner for attachment to the basketball rim assembly support apparatus 12 in a manner to be explained.

The basketball rim assembly support apparatus 12 includes a basketball rim assembly 70 connected to a support and rim connector assembly 72. The basketball rim assembly 70 includes 1) a basketball rim member 74; 2) a basketball net member 76 connected to the basketball rim member 74 in a conventional manner; and 3) a rim support assembly 78 which provides the main support to the basketball rim member 74. The rim support assembly 78 can be of a normal frame structure or a breakaway type that is used to prevent damage to the glass backboard member 18. In a breakover type of the basketball rim assembly 70, the basketball rim member 74 is pivotally connected to the rim support assembly 78 and pivots downwardly on excessive force applied thereto especially in a basketball play dunking operation.

The rim support assembly 78 is provided with a rim support frame 80 having a vertically extended rim anchor plate 82 secured thereto. The rim anchor plate 82 is provided with four spaced anchor holes 84 in corner areas thereof for attachment to the support and rim connector assembly 72 as will be explained.

The support and rim connector assembly 72 is provided with two embodiments being 1) a frame support and rim connector assembly 86 used with the four corner backboard support 36; and 2) a center mount support and rim connector assembly 88 used with the center mount backboard support 38. The frame support and rim connector assembly 86 includes 1) a vertical support strut assembly 90; and 2) a basketball rim support assembly 92.

The vertical support strut assembly 90 includes 1) an upper strut support assembly 94; 2) an intermediate support strut assembly 96 connected at one end to the upper strut support assembly 94; and 3) a lower strut support assembly 98 connected to a lower end of the intermediate support strut 96. The upper strut support assembly 94 includes 1) a strut support plate 102; 2) a pair of parallel rigid support plates 104, 106 secured as by welding to one surface of the strut support plate 102; and 3) a strut connector assembly 108 to interconnect same to the intermediate support strut 96 and, additionally, to the upper support member 24 of the backboard support frame 20.

The strut support plate 102 is provided with a pair of backboard connector holes 110 placed in upper opposite corners.

The rigid support plates 102, 104 are each provided with a pair of spaced aligned connector holes 112 for attachment to the intermediate support strut 96. More particularly, the strut connector assembly 108 includes nut and bolt members 114 placed through the backboard connector holes 110 in the strut support plate 102 and aligned holes in the upper support member 24 of the backboard support frame 28 for anchoring thereto.

Further, the strut connector assembly 108 includes clamp nut and bolt members 116 placed through the aligned connector holes 112 in the rigid support plates 104, 106 and openings in the intermediate support strut 96.

The intermediate support strut 96 is of generally rectangular bar stock shape in transverse cross section having upper strut support plate opening 118 to receive the clamp nut and bolt members 116 therethrough and lower strut support plate openings 120 for connection to the lower strut support assembly 98 as will be noted.

The lower strut support assembly 98 includes a pair of the previously described rigid support plates 104, 106 having aligned connector holes 112 therein. The rigid support plates 104, 106 are secured as by welding to the basketball rim support assembly 92 as noted in FIG. 2.

The basketball rim support assembly 92 includes a main support plate member 128 of generally "U" shape secured by a rim and frame connector assembly 129 to the rim anchor plate 82 of the basketball rim member 70 and, additionally, to the lower support member 26 of the backboard support frame 20.

The main support plate member 128 has a main front wall 130 integral with an intermediate wall 132 which, in turn, is integral with a back wall 134. The front wall 130 is provided with holes 136 for connection to the rim anchor plate 82 of the basketball rim assembly 70. The back wall 134 is provided with holes 138 for connection to the lower support member 26 of the backboard support frame 28 and the rim anchor plate 82.

The rim and frame connector assembly 129 includes upper connector members 140 being tapered nut and bolt members and lower connector members 142 which are nut and bolt members.

The second embodiment of the support and rim connector assembly 72 being the center mount support and rim connector assembly 88 includes 1) a basketball rim support assembly 150 and a rim and frame connector assembly 131.

The basketball rim support assembly 150 includes a main support plate member 128 as previously described including the front wall 130 with holes 136 therein; the intermediate wall 132; and the back wall 134 with the holes 138 therein.

The rim and frame connector assembly 131 includes upper connector members 140 and lower connector members 142. The upper connector members 140 include tapered nut and bolt members 144 and inner nut and bolt member 152.

It is noted that the difference between the four corner backboard support 36 and the center mount backboard support 38 is that the vertical support strut assembly 90 is not used with the center mount support and rim connector assembly 88. With the center mount support of FIGS. 4 and 5, the nut and bolt members 146, tapered nut and bolt members 144, and nut and bolt member 152 are utilized to interconnect the support connector plate 68 directly to the main support plate 128. Additionally, the support plate 68 is connected by the nut and bolt members 146 through openings in the lower support member 26; the back wall 134; the front wall 130; and anchor holes 84 in the rim anchor plate 82 as best noted in FIG. 6.

USE AND OPERATION OF THE INVENTION

Figure 2:
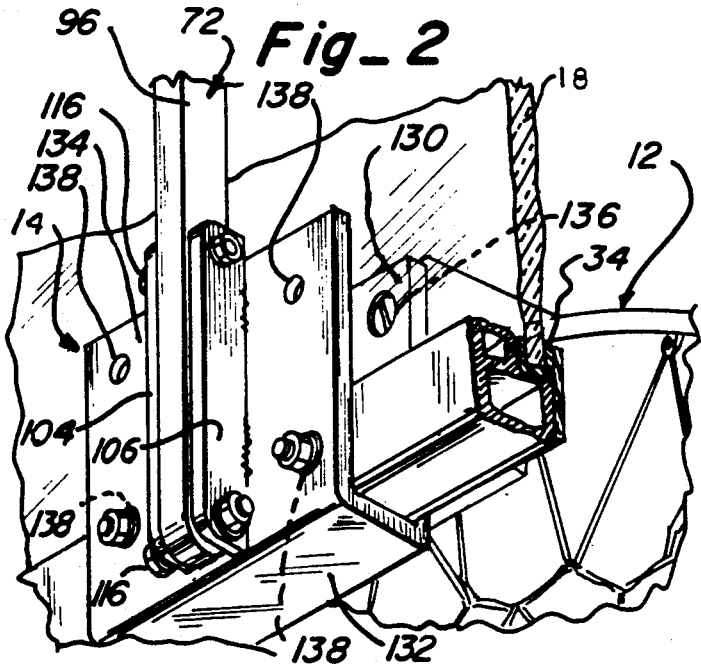
FIG. 2 is an enlarged fragmentary perspective view illustrating a portion of a frame support and rim connector assembly of the basketball rim assembly support apparatus of this invention.
Figure 3:
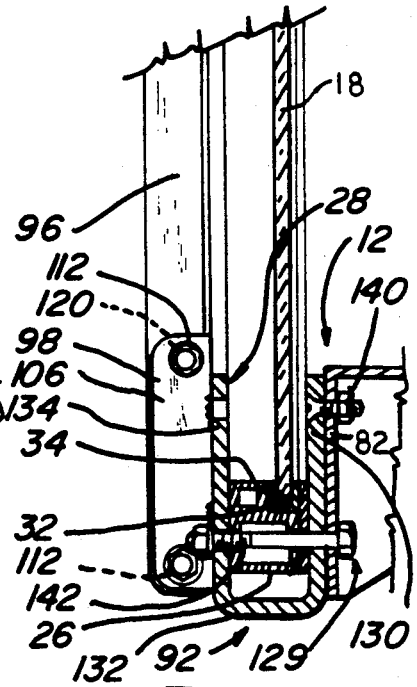
FIG. 3 is an enlarged fragmentary sectional view taken along line 3—3 in FIG. 1.

In the use and operation of the basketball rim assembly support apparatus 12 of this invention, first refer to FIGS. 1–3 which illustrates the invention as mounted on a four corner basketball support 36. In this embodiment, the connector members 46, 54 are used to attach the backboard 36 support at each corner thereof to the backboard support frame 20. The adjustment member 52 on the main support strut 48 is operable to place the backboard glass member 18 is an exact vertical plane to set the basketball rim member 74 in the proper horizontal position.

The vertical support strut assembly 90 is secured by the nut and bolt members 114, 116, 142 to 1) the upper support member 24; 2) the lower support member 26; 3) the upper strut support assembly 94; and 4) the lower strut support assembly 98. Concurrently, the basketball rim support assembly 92 with the main support plate member 128 is placed about the lower support member 26 and bolted thereto by the connector members 142 which are extended through aligned holes within the lower support member 26 and openings in the rim anchor plate 82 as noted in FIG. 3. Additionally, the upper connector members 140 with the tapered nut and bolt members are secured through upper holes 136 in the rim anchor plate 82.

Therefore, it is noted that the frame support and rim connector assembly 86 is operable through the vertical support strut assembly 92 to provide a rigid support structure between the upper support member 24 and the lower support member 26 of the backboard support frame 20. Additionally, it is seen that the basketball rim assembly 70 is securely fastened to the front wall 130 of the main support plate member 128. This provides the necessary rigid support of the basketball rim assembly 70 without requiring the placing of any holes or contact with the backboard glass member 18. This achieves the desired feature of the invention to prevent breakage of the backboard glass member 18 on applying extreme pressure to the basketball rim member 74 during normal basketball play operations and, more specifically, during basketball dunking operations.

Figure 6:
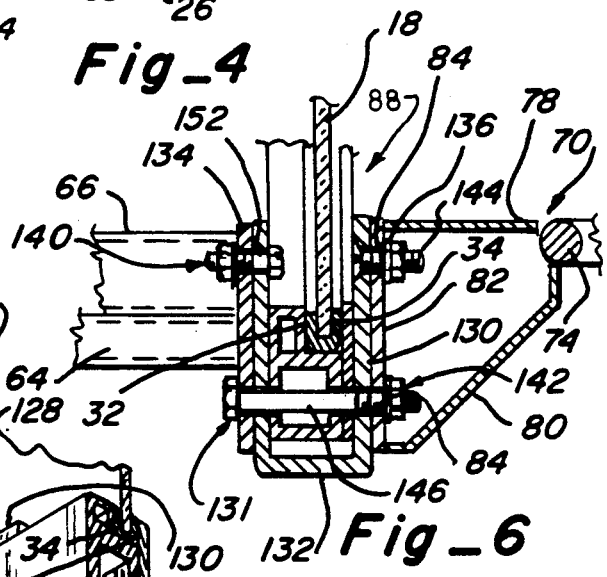
FIG. 6 is a view similar to FIG. 3 being a fragmentary sectional view taken along line 6—6 in FIG. 5.

In the second embodiment of the invention as noted in FIGS. 4–6, inclusive, the center mount support and rim connector assembly 88 is operable to be connected to the support connector plate 68 of the center mount backboard support 38 through the use of the rim and frame connector assembly 131. More specifically, as noted in FIG. 6, the nut and bolt members 146 are extended through aligned openings in the lower portion of the support connector plate 68; the lower support member 26; the front wall 130 of the basketball rim support assembly 92; and the rim anchor plate 82 of the basketball rim assembly 70.

It is noted with the center mount support and rim connector assembly 88 that the basketball rim assembly 70 is rigidly supported through connection to the lower support member 26 of the backboard support frame 20 and the support connector plate 68 of the center mount backboard support 38. Therefore, any forces which are applied to the backboard rim member 74 are transferred to the backboard support frame 20 and the center mount backboard support 38 without any stress placed directly or indirectly on the backboard glass member 18 to prevent breakage thereof.

The rim support assembly 78 could be of a known basketball rim breakaway type which would further control the forces against the backboard support frame 20 to further assure that breakage forces would not be applied to the backboard glass member 18.

The basketball rim assembly support apparatus 12, of this invention, allows the mounting of the backboard glass member 18 about its outer periphery within the glass support grooves 32 and further protected by the resilient "U" shaped support pad 34 to prevent breakage and fatigue thereof. It has been found that the placement of holes through the backboard glass member 18, as done in the prior art in placing mounting bolts therethrough, creates areas of stress and fatigue which eventually lead to the destruction and breakage of the backboard glass member 18.

The basketball rim assembly support apparatus of this invention is economical to manufacture; sturdy in construction; and substantially maintenance free.

While the invention has been described in conjunction with preferred embodiments thereof, it will be understood that this description is intended to illustrate and not to limit the scope of the invention, which is defined by the following claims:

I claim:

1. A basketball rim assembly support apparatus mounted on a backboard support frame having upper and lower support members enclosing a glass backboard member and connected to a basketball rim assembly, comprising:

a) a frame support and rim connector assembly including a vertical support strut assembly and a basketball rim support assembly;

b) said vertical support strut assembly secured at an upper end to the upper support member of the basketball support frame; and c) said basketball rim support assembly includes a main support plate member having a back wall and a front wall, said back wall is secured to a lower end of said vertical support strut assembly; and said front wall is secured to the lower support member of the basketball support frame and the basketball rim assembly;

whereby forces applied against the basketball rim assembly are transferred to said basketball rim support assembly; said vertical support strut assembly; and the basketball support frame and not to the glass backboard member to prevent breakage thereof.

2. A basketball rim assembly support apparatus as described in claim 1, wherein:

a) said vertical support strut assembly includes 1) an upper strut support assembly secured to the upper support member of the basketball support frame; 2) an intermediate support strut having one end secured to said upper support strut assembly; and 3) a lower support strut assembly secured to the lower support member of the basketball support frame and to said back wall of said main support plate member of said basketball rim support assembly.

3. A basketball rim assembly support apparatus as described in claim 2, wherein:

a) said basketball rim assembly includes a rim and frame connector assembly to 1) connect said upper strut support assembly to the upper support member of the basketball support frame, 2) to connect said lower strut assembly to said main support plate member to said intermediate support strut; and 3) to connect the basketball rim assembly to said lower support member with said rim and frame connector assembly providing substantial rigidity to the basketball rim assembly without applying any forces or requiring mounting openings in the glass backboard member.

4. A basketball rim assembly support apparatus mounted on a center mount backboard support and a basketball support frame enclosing a glass backboard member and having a lower support member connected to a basketball rim assembly, comprising:

a) a center mount support and rim connector assembly including a basketball rim support assembly;

b) said basketball rim support assembly includes a main support plate member having a back wall and a front wall, said back wall secured to a support connector plate of the center mount backboard support and said front wall secured to the lower support member of the basketball support frame and the basketball rim assembly;

whereby forces applied against the basketball rim assembly are transferred to said basketball rim support assembly and the support connector plate of the center mount backboard support and not the the glass backboard member to prevent breakage thereof.

5. A basketball rim assembly support apparatus as described in claim 4, wherein:

a) said main support plate member of genrally "U" shape in transverse cross section having said front wall secured to the basketball rim assembly, said back wall secured to the support connector plate, and enclosing the lower support member of the basketball support frame to provide a rigid support for the basketball rim assembly without requiring the placing holes or contact with the glass backboard member to prevent breakage thereof.

6. A basketball rim assembly support apparatus as described in claim 5, wherein:

a) said rim and frame connector assembly includes connector members to 1) anchor the support connector plate to said back wall of said main support plate member, and 2) the lower support member of the basketball support frame to said front wall member and the basketball rim assembly to provide a rigid connection;

whereby forces applied to the basketball rim assembly are applied directly to said main support plate member; the lower support member of the basketball support frame; and the support connector plate of the center mount backboard support to prevent any forces to be applied directly or indirectly to the glass backboard member.

7. A basketball rim assembly support apparatus as described in claim 4, wherein:

a) said main support plate member surrounds and encloses the lower support member of the basketball support frame and having a rim and frame connector assembly to secure same thereto.

8. A basketball rim assembly support apparatus mounted on a basketball support frame having upper and lower support members enclosing a glass backboard member and connected to a basketball rim assembly, comprising:

a) a basketball rim support assembly includes a main support plate member having a front wall and a back wall, said back wall secured to said lower support member of said basketball support frame and said front wall secured to said basketball rim assembly;

whereby forces applied against said basketball rim assembly are transferred to said basketball rim support assembly and said basketball support frame and not to the glass backboard member to prevent breakage thereof.

9. A basketball rim assembly support apparatus as described in claim 8, wherein:

a) said main support plate member having said back wall which is connected to a vertical support strut assembly which, in turn, is connected to said upper support member of said basketball support frame to provide rigidity and integral connection between said basketball rim member; said basketball rim support assembly; said vertical support strut assembly; and said upper support member of said basketball support frame.

10. A basketball rim assembly support apparatus mounted on a backboard support frame having upper and lower support members enclosing a glass backboard member and connected to a basketball rim assembly, comprising:

a) a frame support and rim connector assembly including a vertical support strut assembly and a basketball rim support assembly;

b) said vertical support strut assembly secured at an upper end to the upper support member of the basketball support frame;

c) said basketball rim support assembly includes a main support plate member secured to a lower end of said vertical support strut assembly, the lower support member of the basketball support frame, and the basketball rim assembly; and d) said main support plate member of "U" shape in transverse cross section having a front wall secured to the basketball rim assembly and a back wall secured to said vertical support strut assembly and operable to enclose the lower support member of the basketball support frame and secured thereto to provide rigid support to the basketball rim assembly;

whereby forces applied against the basketball rim assembly are transferred to said basketball rim support assembly; said vertical support strut assembly; and the basketball support frame and not to the glass backboard member to prevent breakage thereof.

* * * * *